US005567194A

United States Patent [19]

Stapleton

[11] Patent Number: 5,567,194

[45] Date of Patent: Oct. 22, 1996

[54] MULTI-FACETED NESTING MODULES

[76] Inventor: Jonathan W. Stapleton, 25 Glacier Ct., Bozeman, Mont. 59715

[21] Appl. No.: 426,931

[22] Filed: Apr. 19, 1995

[51] Int. Cl.[6] ..... A63H 33/06

[52] U.S. Cl. ..... 446/124; 446/85

[58] Field of Search ..... 446/124, 85, 125, 446/101; 434/403; D21/108

[56] References Cited

U.S. PATENT DOCUMENTS

| | | | |
|---|---|---|---|
| Re. 20,652 | 2/1938 | Hecht | 446/101 |
| D. 213,709 | 4/1969 | Gale | D21/108 |
| D. 316,434 | 4/1991 | Stephenson | D21/108 |
| D. 317,801 | 6/1991 | Tapdrup | D21/157 |
| D. 326,486 | 5/1992 | Klitsner | D21/108 |
| 1,648,199 | 11/1927 | Sargent | 446/101 |
| 2,691,243 | 10/1954 | Rade | 446/101 |
| 3,659,360 | 5/1972 | Zeischegg | 434/403 |
| 3,950,888 | 4/1976 | Hogan | 446/124 |
| 3,999,327 | 12/1976 | Immordino | 446/73 |
| 4,113,256 | 9/1978 | Hutchings | 434/403 X |
| 4,682,966 | 7/1987 | Kagan | 446/101 |
| 5,104,345 | 4/1992 | Lyman | 446/101 |

*Primary Examiner*—Mickey Yu
*Attorney, Agent, or Firm*—Richard C. Conover

[57] ABSTRACT

The present invention relates to a multi-faceted nesting module for building complex geometric structures from a plurality of identical modules. A module includes a body shaped to have faces corresponding with the facial geometry of a three-dimensional lattice made up of tangent polyhedral cells. The module further includes appendages attached to the body and extending only into an adjacent cell of the lattice defined by the body. The appendages have at least one face corresponding with the facial geometry of the three-dimensional lattice but also have cut-away portions where the resulting faces do not interfere with the facial geometry of the three-dimensional lattice.

5 Claims, 8 Drawing Sheets

MULTI-FACETED NESTING MODULES

BACKGROUND OF THE INVENTION

Toy building blocks for constructing repeating geometric structures from identical blocks are known. For example the well known cube sets widely used as toys comprise a plurality of identical cubes which can be stacked side by side or on top of one another. More complex building modules are also known such as the module shown in U.S. Pat. No. 3,950,888 to Hogan; U.S. Pat. No. 4,492,723 to Chadwick, II; and U.S. Pat. No. 3,659,360 to Zeischegg. All of these known construction sets have a disadvantage in that they can not be stacked to form complex structures without using special connecting means such as pins for inserting into holes. All of the known construction sets further have the disadvantage of limited possibilities for assembling complex bodies.

SUMMARY OF THE INVENTION

The present invention relates to a multi-faceted building module for building complex geometric structures from a plurality of identical modules. The present invention includes a body shaped to have faces corresponding with the facial geometry of a three-dimensional lattice made up of tangent polyhedral cells and further includes appendages attached to the body and extending only into an adjacent cell of the lattice defined by the body. The appendages have at least one face corresponding with the facial geometry of the three-dimensional lattice but also have cut-away portions where the resulting faces do not interfere with the facial geometry of the three-dimensional lattice. Two preferred embodiments are shown and described, the first being a "walking turtle" having a head appendage and four leg appendages, and the second being a "swimming turtle" also having a head appendage but with four leg appendages differently oriented and shaped than the "walking turtle".

BRIEF DESCRIPTION OF THE DRAWINGS

In order that the invention may be clearly understood and readily carried into effect, the preferred embodiments of the invention will now be described, by way of example only, with reference to the accompanying drawings wherein.

DESCRIPTION OF PREFERRED EMBODIMENTS

Figure 2:
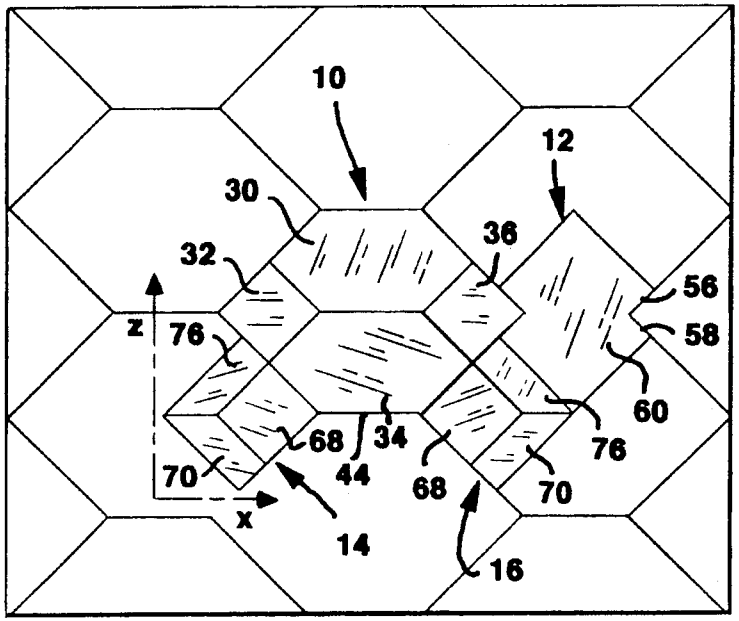
FIGS. 2–6 are respectively front elevation, right side elevation, left side elevation, top plan view, and bottom plan view of the embodiment shown in FIG. 1 with shading added to the faces for clarity and the "walking turtle" also shown embedded in a three-dimensional lattice defined by the body.
Figure 1:
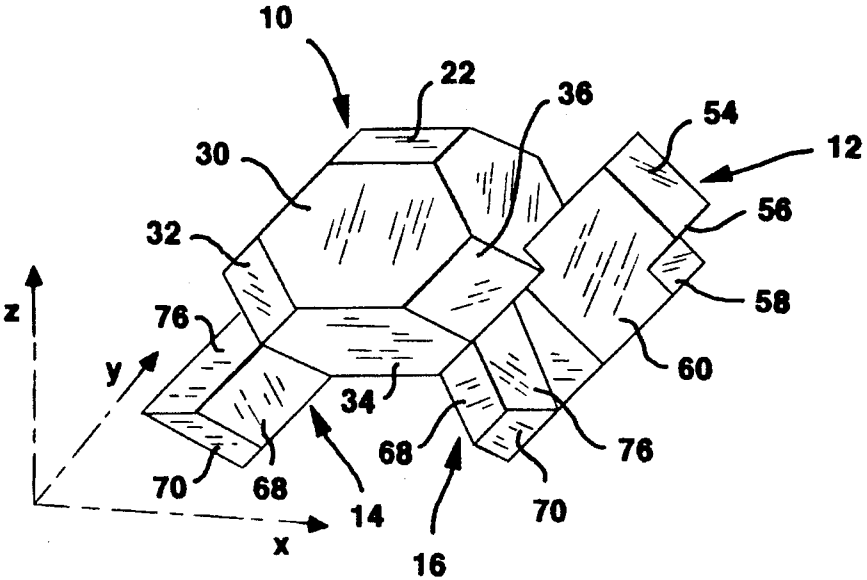
FIG. 1 is a perspective view of a preferred embodiment of the present invention showing a "walking turtle"
Figure 4:
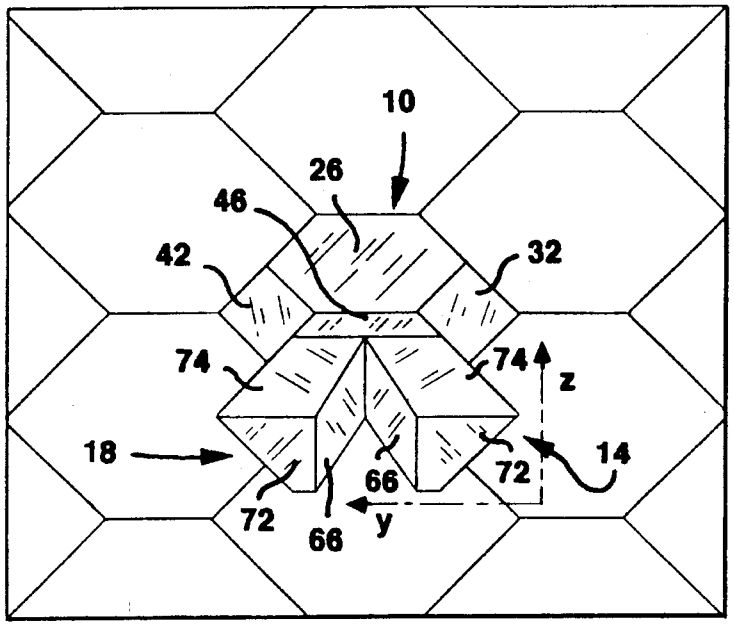
Figure 3:
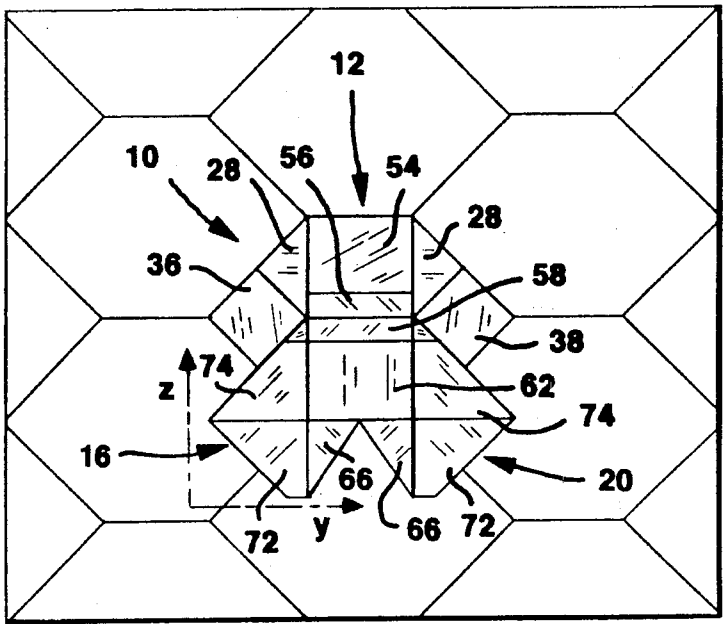
Figure 6:
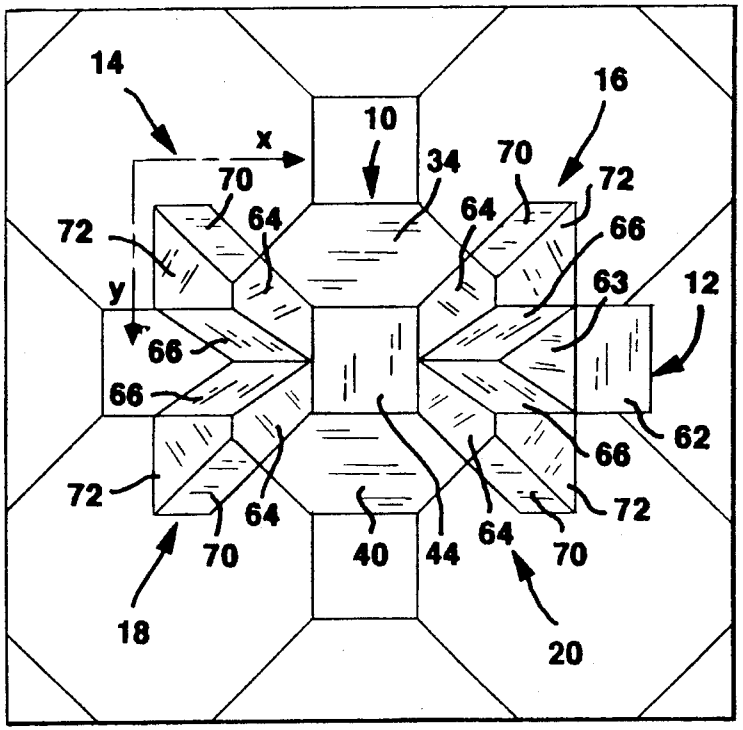
Figure 5:
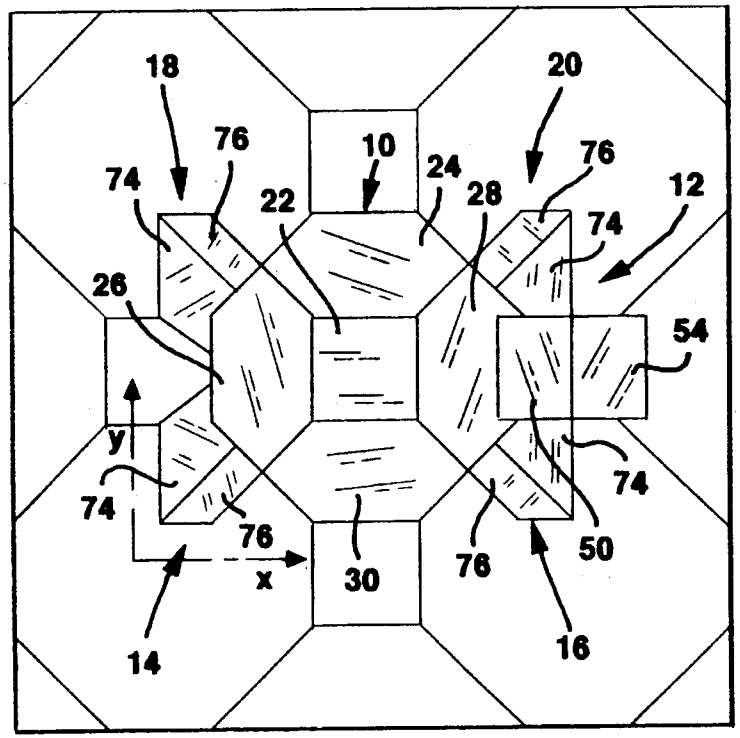

FIG. 1 is a perspective view of a "walking turtle" according to the present invention showing a body 10, a head appendage 12 and two of the four identical leg appendages 14, 16, 18, and 20 respectively. For purposes of illustration of how these multifaceted modules are constructed for the "walking turtle", reference is made to FIGS. 2–6. Each figure shows a block of material, which in a preferred embodiment is wood, on which is imposed the facial geometry of a three-dimensional lattice. The three-dimensional lattice is defined as an array of tangent polyhedral cells having planar faces wherein all of the planar faces of a cell tangentially abut a planar face of an adjacent cell. The lattice is shown in a conventional X-Y-Z coordinate system. FIG. 2 shows the X-Z plane, FIGS. 3 and 4 shown the Y-Z plane, and FIG. 5 and FIG. 6 show the X-Y plane. The extending modules of the three-dimensional lattice made up of 14 sided tangent polyhedral cells is shown in FIGS. 2, 3 and 4 as a hexagon and in FIGS. 5 and 6 as an octagon.

In conformance with this lattice configuration, the body 10 has 14 surfaces. These surfaces are labeled 22–48. It will be seen that each of the faces 22–48 align with a corresponding face of the three-dimensional lattice.

The head appendage is cut away from two abutting cells of the lattice and is attached to the body. This head appendage has seven exposed surfaces labeled 50–62. Surfaces 56 and 58 are coplanar with corresponding faces of the three-dimensional lattice as shown in FIGS. 2 and 3. Surfaces 50, 54, and 62 are parallel to corresponding surfaces of the lattice.

Each leg appendage 14, 16, 18, and 20 is cut away from an abutting cell of the lattice and has seven surfaces 64–76. Surfaces 64, 68, 70 and 76 are coplanar with corresponding faces of the lattice. Surfaces 72 and 74 are parallel to corresponding faces of the lattice.

Figure 13:
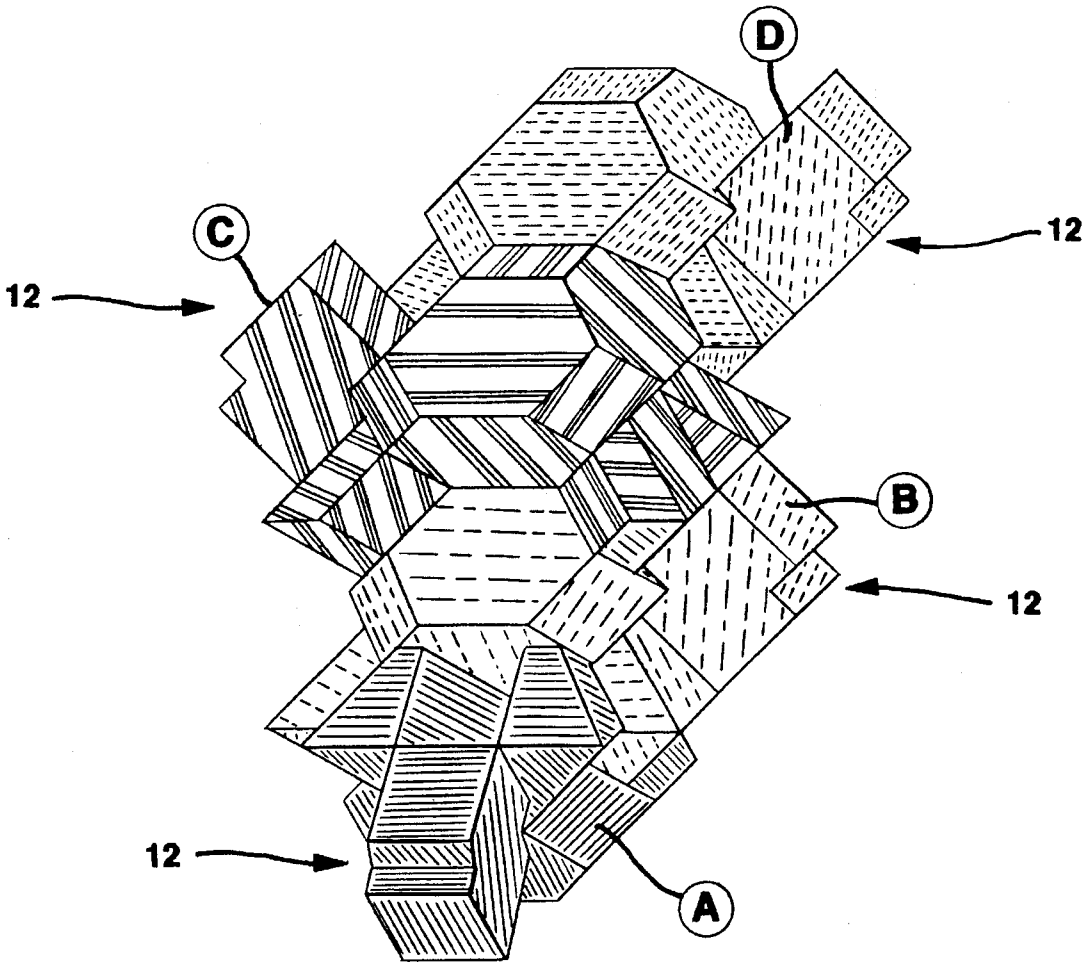
FIG. 13 is a perspective view of four "walking turtles" nested together with three different adjacent nesting positions.

Several nesting configurations of the modules is accomplished as shown in FIG. 13 so that some of the surfaces 64, 68, 70 and 76 of one or more of the four legs nest with complimentary surfaces of another identical module. Aligning these surfaces of the legs with the lattice defined by the body guarantees such nesting. In FIG. 13, when viewing "walking turtles" A and B, surface 44 of the B "walking turtle" abuts against complimentary surfaces 44 of the inverted A "walking turtle". When nesting, the stacking of many modules with appendages makes the stack more rigid than when stacking with toy cube blocks, for example.

The faces of a module coplanar with the lattice, if sized to not extend beyond the lattice facial boundary, allow for nesting of modules within the lattice. The faces of the module parallel with, but not coplanar with, the faces of the lattice allow for nesting the modules in an offset lattice.

Figure 8:
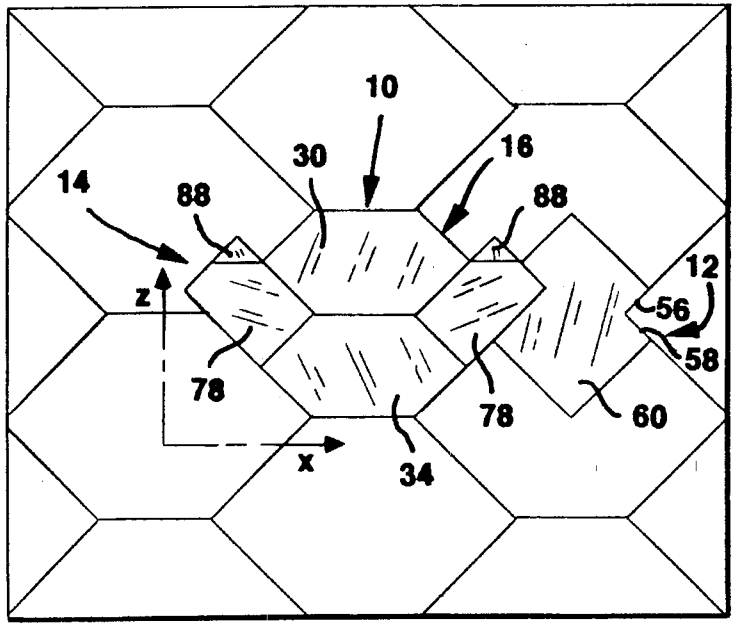
FIGS. 8–12 are respectively a front elevational view, right side elevational view, left side elevational view, top plan view, and bottom plan view of the "swimming turtle" shown in FIG. 7 with shading added to the faces for clarity and the "swimming turtle" also shown embedded in a three-dimensional lattice defined by the body.
Figure 7:
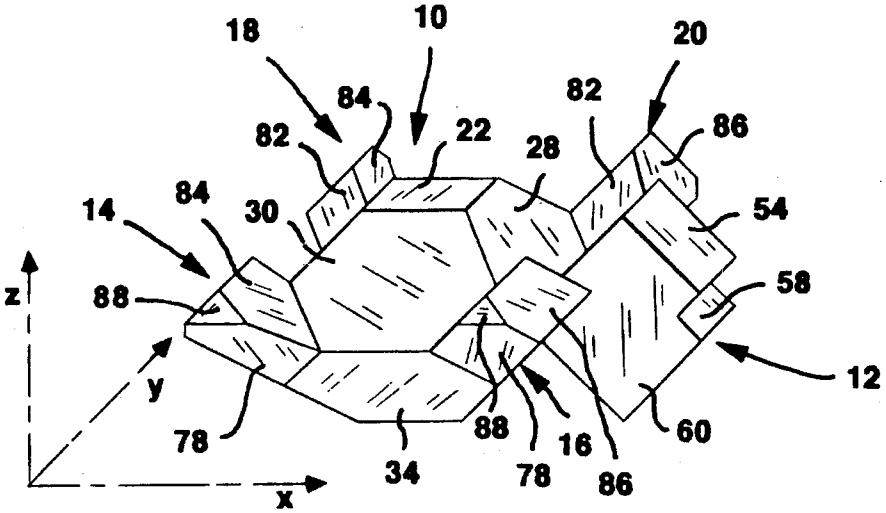
FIG. 7 is a perspective view of another embodiment of the present invention showing a "swimming turtle"
Figure 10:
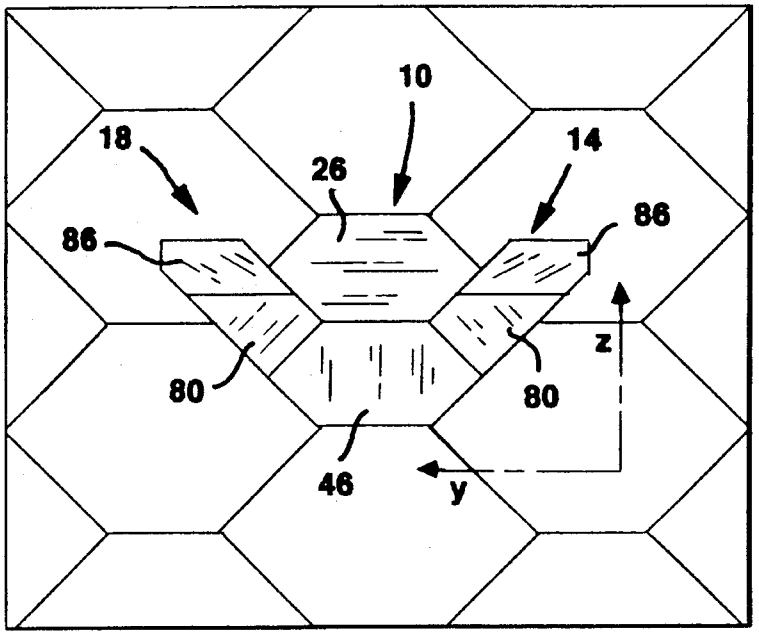
Figure 9:
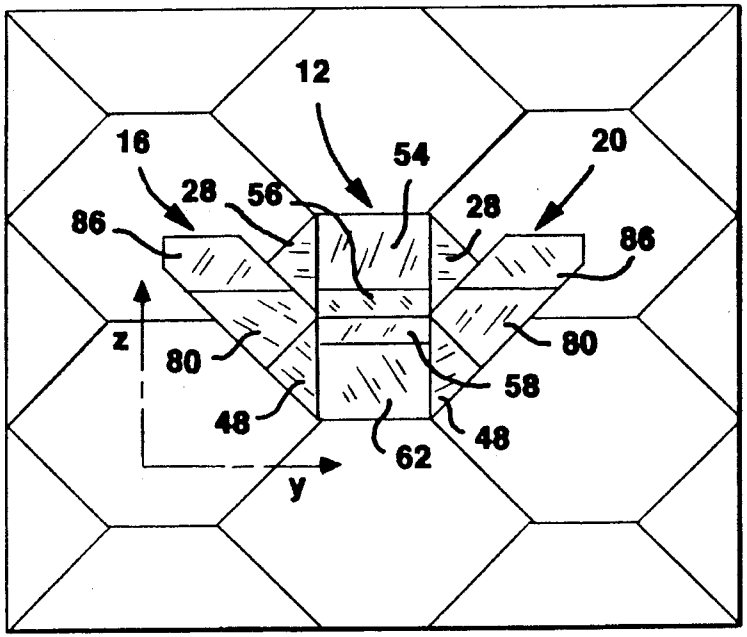
Figure 12:
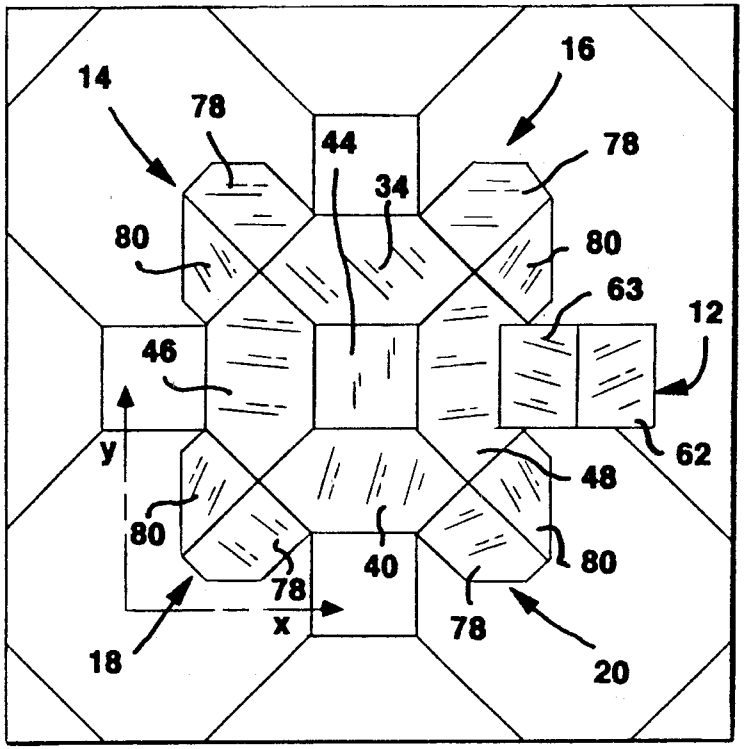
Figure 11:
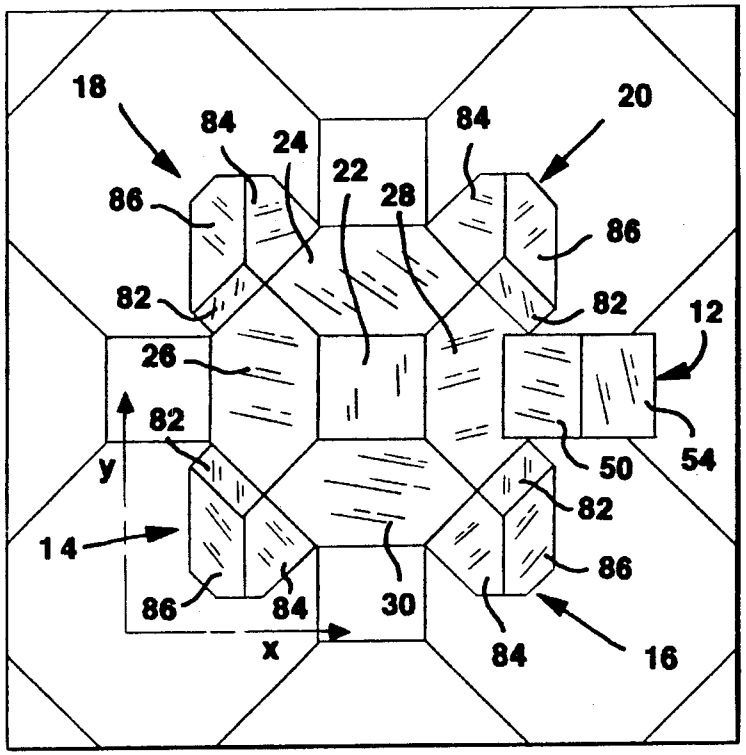

A second embodiment of the present invention, which is the "swimming turtle" embodiment, is shown in FIGS. 7–12. FIG. 7 is a perspective view of a "swimming turtle" according to the present invention. FIGS. 8–12 show a block of material, which in a preferred embodiment is wood, on which is imposed a geometrical lattice as was the case with FIGS. 2–6. The lattice is shown in a conventional X-Y-Z coordinate system. FIG. 8 shows the X-Z plane, FIGS. 9 and 10 show the Y-Z plane, FIG. 11 and FIG. 12 show the X-Y plane. Again, the extending modules of the three-dimensional lattice of tangent polyhedral cells is shown in FIGS. 8, 9, and 10 as a hexagon and in FIGS. 11 and 12 as an octagon.

This embodiment also has a body 10, a head appendage 12, and four leg appendages 14, 16, 18, and 20. The body portion is shaped similarly to the body portion of the first embodiment and corresponding faces of the "swimming turtle" are labeled with the same element numbers as the body of the "walking turtle". The head appendage 12 of the second embodiment is also shaped similarly to the head appendage 12 of the first embodiment and again the faces are labeled with the same element numbers.

The leg appendages are oriented and shaped a little bit differently than the first embodiment. The exposed faces of each leg are labeled with the element numbers 78–88. Each of the leg segments has the same shape and has six surfaces. Faces 82 and 84 are coplanar with corresponding faces of the three-dimensional lattice as shown in FIG. 11 and surfaces 78, 80 and 86 are parallel to corresponding faces of the lattice.

Figure 14:
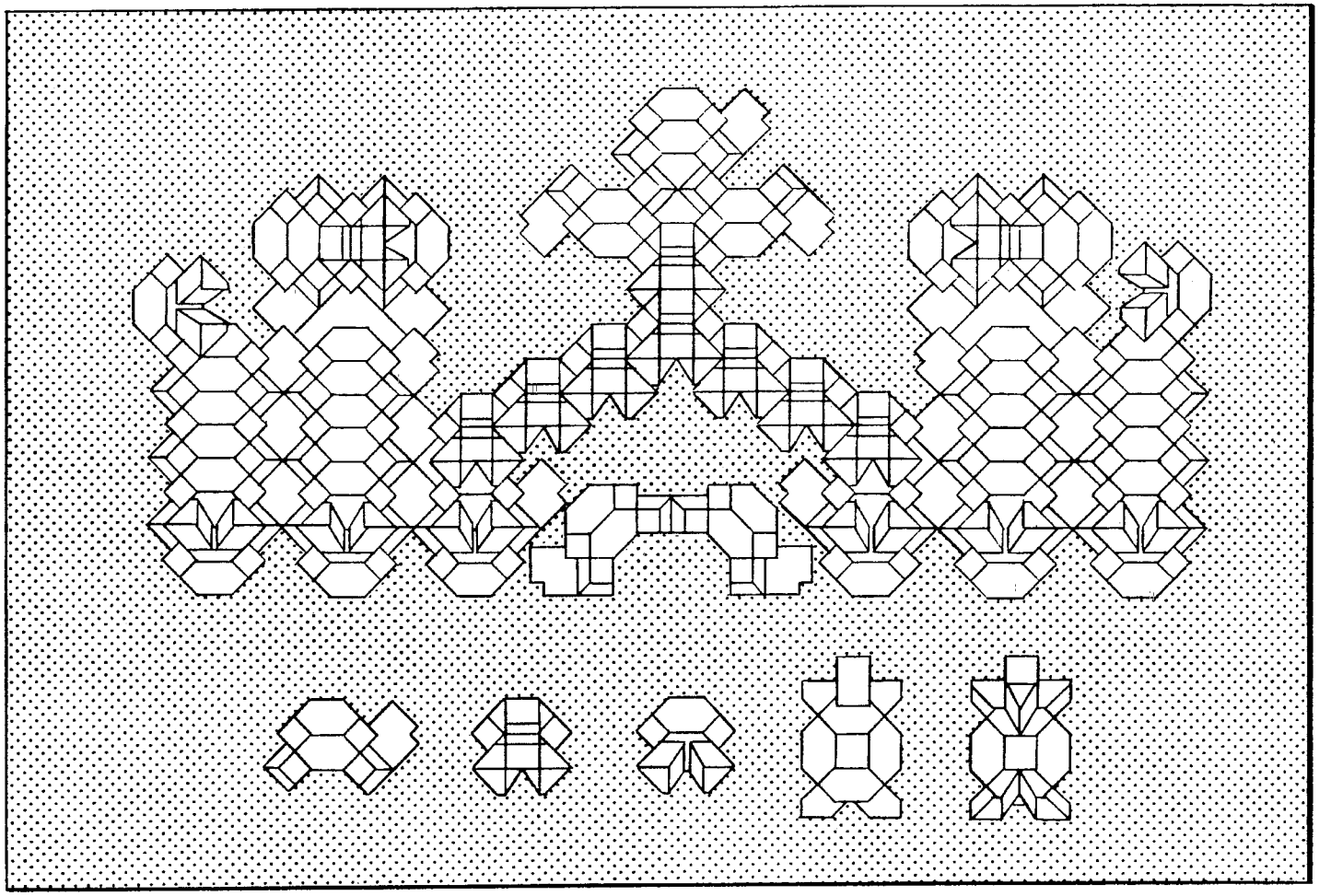
FIG. 14 is a perspective view of an example of a complex structure which can be constructed from "walking turtles" which has a small replica of a front side, right side, left side, leg and bottom drawn at the bottom for assistance in visualizing the nesting capabilities of the present invention.

In operation, multiple "turtles" of either embodiment can be nested in complex structures. FIG. 13 illustrates a structure of four "waling turtles", A, B, C, and D, nested with A upside down and B positioned upright across A and rotated 90°. "Walking turtle" C is positioned on top of "walking turtle" B and faces in the opposite direction as B. "Walking turtle" D is positioned against the upper half of "walking turtle" C and again faces the opposite direction from C. The appendages assist in keeping the stack nested. FIG. 14 illustrates a typical and much more complicated example of the nesting possibilities associated with the present invention.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

I claim:

1. A multi-faceted module for constructing nested structures of identical modules each module comprising:

a body shaped to have at least three planar faces each coplanar with a face of a three-dimensional geometrical lattice; and appendages attached to the body wherein each appendage has at least one planar face coplanar with a face of the lattice and has at least one other planar face parallel to but not coplanar with a face of the lattice.

2. A multi-faceted module for constructing nested structures of identical modules each module comprising:

a body shaped to have at least one planar face coplanar with a face of a three-dimensional geometrical lattice; and appendages attached to the body wherein each appendage has at least one planar face coplanar with a face of the lattice and has at least one other planar face parallel to but not coplanar with a face of the lattice;

the appendages positioned to cooperate with one another to nest with another identical module with complimentary surfaces abutting.

3. A multi-faceted module for building nested structures comprising:

a body shaped to have faces corresponding with a facial geometry of a three-dimensional lattice where each cell of the lattice comprises a polyhedron with 14 faces;

a head appendage attached to the body having seven exposed planar faces, two of which are aligned with the facial geometry of the lattice, and three of which are parallel with corresponding faces of the lattice; and four leg appendages attached to the body having seven planar faces, four of which are aligned with the facial geometry of the lattice, and two of which are parallel with corresponding faces of the lattice.

4. The multi-faceted module according to claim 3 wherein the leg appendages are positioned to cooperate with one another to nest with another identical module with complimentary surfaces abutting.

5. A multi-faceted module for building nested structures comprising:

a body shaped to have faces corresponding with a facial geometry of a three-dimensional lattice where each cell of the lattice comprises a polyhedron with 14 faces;

a head appendage attached to the body having seven exposed planar faces, two of which are aligned with the facial geometry of the lattice, and three of which are parallel with corresponding faces of the lattice; and four leg appendages attached to the body having six exposed planar faces, two of which are aligned with the facial geometry of the lattice, and three of which are parallel with corresponding faces of the lattice.

* * * * *